US007550050B2

(12) United States Patent
Lewin

(10) Patent No.: US 7,550,050 B2
(45) Date of Patent: Jun. 23, 2009

(54) METHOD AND APPARATUS FOR COOLING STRIP AND WIRE MATERIAL

(75) Inventor: Thomas Lewin, Hallstahammar (SE)

(73) Assignee: Sandvik Intellectual Property AB, Sandviken (SE)

( * ) Notice: Subject to any disclaimer, the term of this patent is extended or adjusted under 35 U.S.C. 154(b) by 407 days.

(21) Appl. No.: 10/540,680

(22) PCT Filed: Dec. 4, 2003

(86) PCT No.: PCT/SE03/01885

§ 371 (c)(1),
(2), (4) Date: Feb. 17, 2006

(87) PCT Pub. No.: WO2004/056503

PCT Pub. Date: Jul. 8, 2004

(65) Prior Publication Data

US 2006/0163780 A1 Jul. 27, 2006

(30) Foreign Application Priority Data

Dec. 23, 2002 (SE) ..... 0203843

(51) Int. Cl.
*C21D 9/52* (2006.01)

(52) U.S. Cl. ..... 148/595; 266/109

(58) Field of Classification Search ..... 266/102, 266/103, 110, 109; 148/595, 600, 601
See application file for complete search history.

(56) References Cited

U.S. PATENT DOCUMENTS

| | | | | |
|---|---|---|---|---|
| 4,062,528 A | | 12/1977 | Olivero | 266/103 |
| 4,738,733 A | * | 4/1988 | Mihara et al. | 148/504 |
| 4,913,650 A | * | 4/1990 | Ritter et al. | 432/59 |

FOREIGN PATENT DOCUMENTS

| | | |
|---|---|---|
| DE | 30 50 507 C1 | 2/1982 |
| GB | 1446946 | 8/1976 |
| JP | 64-048619 A | 2/1989 |

* cited by examiner

*Primary Examiner*—Scott Kastler
(74) *Attorney, Agent, or Firm*—Alfred J. Mangels

(57) ABSTRACT

A method of cooling strip or wire products in which, subsequent to being annealed, the product is cooled to a temperature of about 20-50° C. below its oxidation temperature. The product is wound around a drum immediately downstream of an annealing path so that the product lies in mutually juxtaposed turns on the drum. It is thereafter unwound from the drum after a number of turns. The number of turns is such that the product is cooled to a desired temperature. The drum has a diameter that exceeds the diameter at which the product will be influenced mechanically by plastic deformation.

12 Claims, 1 Drawing Sheet

METHOD AND APPARATUS FOR COOLING STRIP AND WIRE MATERIAL

BACKGROUND OF THE INVENTION

1. Field of the Invention

The present invention relates to a method and to apparatus for cooling strip and wire material.

2. Description of the Related Art

In the manufacture of strip and wire material, the material is normally annealed after being finally rolled or drawn, respectively. In the case of stainless steel, a typical annealing temperature is 900-1200° C., and the product is annealed continuously after being worked. This follows with controlled cooling of the product to a typical temperature of 20-50° C. below the oxidation temperature.

In normal operation, the wire or strip speed may be about 1 m/s. Because the cooling process will necessarily take a given amount of time to carry out, it is necessary that the path along which the cooling process takes place is relatively long.

According to earlier techniques, the cooling path is essentially straight, among other reasons because the annealed material is extremely sensitive to plastic deformation and therewith easily damaged when passing through curved cooling paths. In turn, this means that the building which houses the cooling path must be very long, for instance in the order of 10 meters or more. Moreover, when cooling wire or strip, it is necessary to handle a long wire rod that is used to thread the product through the cooling path to a coiling plant.

Thus, it is desirable to be able to reduce the length of the cooling path and thereby reduce the space required to accommodate said path, and also to reduce the smallest necessary length of said path required by the wire rod used to lead the product through the furnace and the cooling path and up to the coiling plant. The furnace and the cooling path are joined together.

SUMMARY OF THE INVENTION

The present invention provides a solution to both of these problems, by placing between the furnace and the coiling plant a rotatable cooling drum onto which the product is wound as it leaves the furnace, and from which said product is unwound for further transportation to the coiling plant. The diameter of the drum is chosen so that the radius of curvature of the product wound onto the drum will exceed the smallest radius of curvature at which plastic deformation will occur and therewith permanently and negatively affect the mechanical properties of the product. Sufficient cooling of the product can also be achieved by winding the product a sufficient number of turns around the cooling drum. As will be realized, this enables the cooling arrangement to be made substantially shorter in the longitudinal direction and also to reduce the length of the shortest wire rod extension required to thread the product.

The invention also enables the product to be returned to its original uncoiling position immediately upon leaving the cooling drum. This is beneficial primarily from an automation aspect and also from an efficiency aspect, and will also contribute to a better working environment and simpler process control.

In order to achieve the object of sufficient cooling of the product, it is necessary that a sufficient thermal mass of the product is rolled onto the drum. In other words, it is necessary to choose the number of turns placed around the drum with regard to the desired cooling effect. When more effective cooling is desired, the cooling effect can be enhanced in different ways:

A first way is by increasing the heat exchange between the product and its surrounding atmosphere by forced convection.

Another way is to further enhance the cooling effect by introduction of a separate cooling medium. This cooling medium may, for instance, be water which is delivered to the inside of the drum. The cooling medium will not therefore come into direct contact with the product but will, instead, effect an exchange of thermal energy through the inner wall of the drum. This inner wall may be given a material quality that will suit the cooling requirement and other conditions and demands relevant at that time. Millimeter-thick stainless steel and thick cast iron are examples of such material qualities. The cooling medium can be applied to the inner wall of the drum with the aid of known technology, by connecting an external cooling medium source to a nozzle placed inside the drum with the aid of a slide coupling. Alternatively, a cooling loop may be fitted on the inside of the drum.

Moreover, it may be beneficial, and necessary, to enclose the cooling product in a shielding atmosphere adapted with respect, for instance, to the carbon potential between said atmosphere and the product. When a shielding atmosphere is used, it is necessary to enclose the drum in a housing in which said atmosphere will be under an overpressure, by way of suggestion. $N_2$, $H_2$, and Ar are examples of shielding atmospheres that can be used.

Finally, when the product is not strong enough per se to be drawn around the drum by the tensile force generated in the product as it is coiled in the coiling plant, the drum will preferably be motor-driven so as to protect the product from mechanical damage due to excessively high tensile forces in the material.

Accordingly, the present invention relates to a method of cooling strip or wire product, in which the product is cooled to a temperature of about 20-50° C. after being annealed. The product is wound around a cooled drum immediately downstream of an annealing path, such that the product will lie in juxtaposed turns around the drum. The product is unwound from the drum after a number of turns have been applied, wherein the number of turns is such as to cool the product to a desired temperature. The drum has a diameter that exceeds the diameter at which the product will be mechanically affected by plastic deformation.

The present invention also relates to a cooling arrangement.

BRIEF DESCRIPTION OF THE DRAWINGS

The present invention will now be described in more detail, partly with reference to an exemplifying embodiment thereof shown in the accompanying drawings, in which.

DESCRIPTION OF THE PREFERRED EMBODIMENTS

Figure 1:
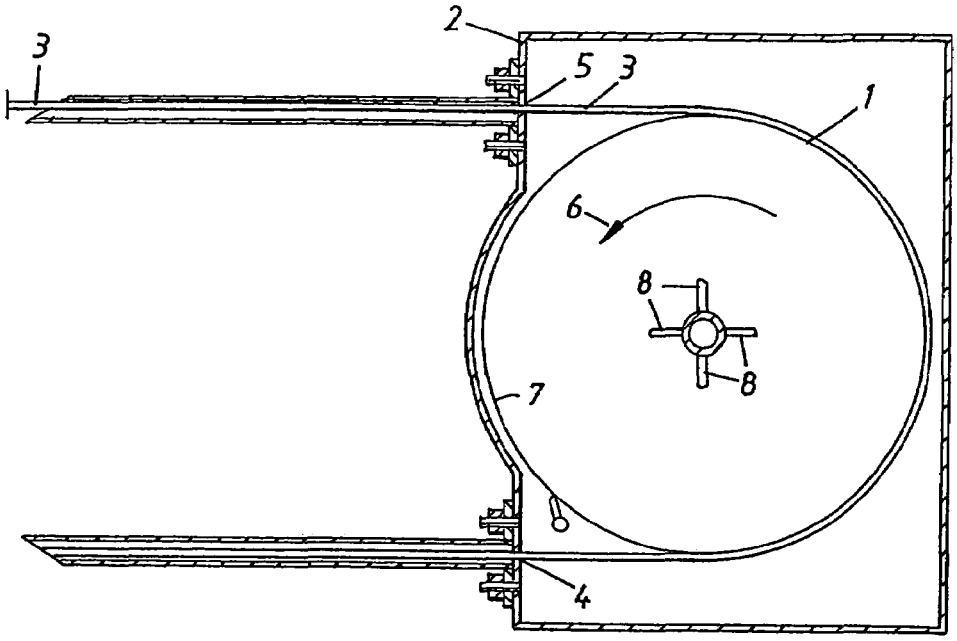
FIG. 1 is an overview of an inventive cooling arrangement.

FIG. 1 illustrates a cooling drum 1 according to the invention. The cooling drum is placed in a surrounding housing 2 in which a shielding atmosphere is contained. The shielding atmosphere is at an overpressure in the housing 2, so as to maintain the atmosphere around the drum 1.

The wire or strip product 3 enters the housing 2 at the inlet 4 and is wound through one or more turns around the drum 1 and then leaves the housing 2 at the outlet 5. The product 3 is annealed at the inlet 4 and has a high temperature at this point. The product 3 is cooler at the outlet 5 and has a temperature which is much closer to room temperature than at the inlet 4. The product is cooled to a temperature of about 20-50° C. below its oxidation temperature.

The product 3 originally moves from a furnace, not shown in the figure. After having passed through the outlet 5, the product 3 moves to a coiling plant (not shown).

Because the inlet 4 and the outlet 5 can be placed on one and the same side of the housing 2, the product 3 can be passed in and out in mutually opposite directions. This enables the coiling plant to be placed in the proximity of the wire-drawing bench or the rolling mill, therewith providing the aforesaid benefits in the form of improved efficiency and working environment among other things.

The drum 1 rotates anti-clockwise, in the direction of arrow 6, so that the product 3 will be wound onto the drum 1 subsequent to its passage through the inlet 4, and is wound onto the drum 1 prior to its passage through the outlet 5. The drum 1 is caused to rotate, either by the tension force created in the product 3 as it is wound up in the coiling plant, or the drum 1 is motor-driven and caused to rotate at a suitable speed so as to be compatible with the advancement of the product 3 through the arrangement and so as to achieve the desired cooling of the product 3.

Convection of the shielding atmosphere in the housing 2 over the product 3 wound onto the drum 1 can be increased, so as to enhance the cooling effect on the product 3 during its passage through the housing 2. This can be achieved with the aid of fans for example.

The cooling effect on the product 3 wound onto the drum 1 can be further enhanced with the aid of an external coolant. This coolant can be used beneficially to cool the inner surface 7 of the drum 1, which surface through the drum wall is in thermal contact with the product 3 wound onto the drum. This enables cooling to be achieved in the absence of direct contact between the coolant and the product 3. The coolant is conveniently applied to the inside 7 of the drum 1 through one or more nozzles 8 situated within the center of the drum 1. Delivery of coolant into the drum 1 can be effected in a known manner, for instance with the aid of a slide coupling between the coolant supply means and the drum 1.

The housing 2 includes one or more housing inspection and housing maintenance doors.

Figure 2:
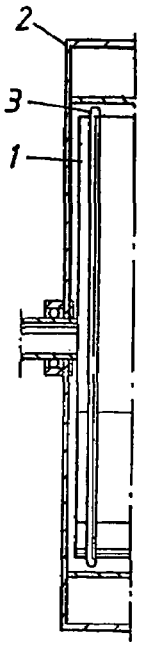
FIG. 2 illustrates part of a cooling drum where only one turn of the product is wound around the drum.
Figure 3:
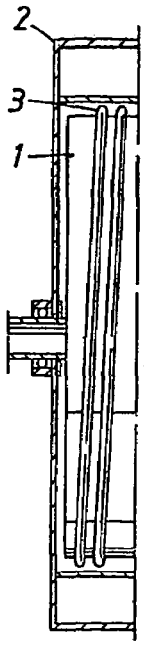
FIG. 3 illustrates part of a cooling drum where the product is wound several turns around the drum.

FIGS. 2 and 3 illustrate detail sections of the drum 1. These figures illustrate the drum 1 located in the housing 2, and the product 3 wound onto the drum 1.

As will be seen from FIG. 2, the product 3 can be wound one turn around the drum 1. In other words, the product 3 may simply be curved around the drum 1 so as to exit on the same side of the housing 2 as that through which it entered, without additional turns being wound around the drum 1.

On the other hand, as shown in FIG. 3, the product 3 can be wound one or more extra turns around the drum 1 prior to said product exiting from the housing 2 on the same side of the housing 2 through which it entered.

The number of additional turns will preferably be chosen with respect to desired cooling of the product 3 during its residence time in the housing 2. This will, of course, vary with the material of the product 3 and its dimensions, and also in respect of the diameter of the drum 1 and other operating conditions.

Although the invention has been described above with reference to a number of embodiments thereof, it will be obvious that these embodiments can be modified with respect to product and desired cooling sequences.

Consequently, the present invention shall not be considered to be restricted to the described embodiments, since variations can be made within the scope of the accompanying claims.

What is claimed is:

1. A method of cooling strip or wire products subsequent to being annealed, said method comprising the steps of:

providing a rotatable cooling drum immediately downstream of an annealing path, wherein the drum has a predetermined outer diameter;

placing the drum in a closed housing that includes a product inlet opening and a product outlet opening;

providing a shielding gas atmosphere within the closed housing and around the cooling drum, wherein the shielding gas atmosphere is provided at an overpressure relative to atmospheric pressure;

winding the product around the cooling drum a plurality of turns so that the product lies in mutual juxtaposed turns on the drum;

cooling the product to a desired temperature of from about 20° C. to about 50° C. below the oxidation temperature of the material; and maintaining the product as it is cooled within a curved path against the outer diameter of the drum and within the shielding gas atmosphere, wherein the drum has an outer diameter that is greater than a diameter at which a radius of curvature of the wound product is influenced mechanically by plastic deformation.

2. A method according to claim 1, wherein the shielding gas atmosphere is selected from the group consisting of argon, hydrogen, and nitrogen gas and combinations and mixtures thereof.

3. A method according to claim 1, including the step of cooling the drum by forced convection of the atmosphere surrounding the drum.

4. A method according to claim 1, including the step of cooling an inner wall of the drum by introducing an external coolant into the drum to increase the rate of cooling of the product.

5. A method according to claim 1, including the step of constructing the drum from a metallic material.

6. A method according to claim 1, including the step of rotating the drum with a drive motor.

7. An arrangement for coding strip or wire material products where the product is cooled after having been annealed, said arrangement comprising: a rotatable cooling drum positioned immediately downstream of an annealing path for receiving on a drum outer surface a plurality of peripheral surface turns of the product that are wound such that the turns of the product are mutually juxtaposed for cooling the product to a desired temperature of from about 20° C. to about 50° C. below the oxidation temperature of the material; a closed housing around the drum, the housing including a product inlet opening and a product outlet opening; means for providing a shielding gas atmosphere within the closed housing; and means for maintaining the product during cooling in a curved path around the outer diameter of the drum and within the shielding gas atmosphere, wherein the drum has an outer diameter that is greater than a diameter at which a radius of curvature of the wound product is influenced mechanically by plastic deformation.

8. An arrangement according to claim 7, including means for introducing into the housing a shielding gas atmosphere selected from the group consisting of argon, hydrogen, and nitrogen gas, and combinations and mixtures thereof.

9. An arrangement according to claim 7, wherein the drum is cooled by forced convection of the atmosphere surrounding the drum.

10. An arrangement according to claim 7, wherein an inner wall of the drum is cooled by an external coolant that is introduced to cool the inside of the drum to increase the rate of cooling of the product.

11. An arrangement according to claim 10, wherein the drum is made of a metallic material.

12. An arrangement according to claim 7, wherein the drum is motor-driven.

* * * * *